United States Patent [19]

Hills

[11] 4,173,291

[45] Nov. 6, 1979

[54] FLOATING ROOF SEAL

[75] Inventor: Richard E. Hills, Coraopolis, Pa.

[73] Assignee: Pittsburgh-Des Moines Steel Company, Pittsburgh, Pa.

[21] Appl. No.: 871,039

[22] Filed: Jan. 20, 1978

[51] Int. Cl.[2] ..... B65D 87/18; B65D 87/20

[52] U.S. Cl. ..... 220/225; 220/222

[58] Field of Search ..... 220/222, 225, 226

[56] References Cited

U.S. PATENT DOCUMENTS

| | | | |
|---|---|---|---|
| 2,997,200 | 8/1961 | Giannini et al. | 220/222 |
| 3,135,415 | 6/1964 | Fino | 220/225 |
| 3,724,705 | 4/1973 | McKibbin | 220/225 |
| 4,014,454 | 3/1977 | Nayler et al. | 220/226 X |

*Primary Examiner*—Steven M. Pollard

*Attorney, Agent, or Firm*—Shoemaker and Mattare, Ltd.

[57] ABSTRACT

A seal for use in a floating roof storage tank. The seal closes the annular space defined between the floating roof and the wall of the storage tank. The seal includes a single, unitary length of pliable material which is folded about the longitudinal axis thereof to superpose the side edges thereof. The end edges are closed and the superposed side edges are attached to the floating roof. A scuffband is attached to the floating roof to be interposed between the envelope and the tank wall, and fluent material can be placed into the envelope when the seal is in situ. A method of forming the seal is disclosed, as is a secondary sealing means.

20 Claims, 9 Drawing Figures

FLOATING ROOF SEAL

BACKGROUND OF THE INVENTION

The present invention in general relates to floating roof storage tanks, and, more particularly, to a seal for use with such tanks.

Evaporation loss is the natural process whereby a liquid is converted into a vapor which subsequently is lost from storage tanks, and evaporation loss occurs only when the vapor reaches the atmosphere. Evaporation loss is a major problem faced by the petroleum industry, and many systems and concepts have been proposed to remedy this problem. Among these proposals is the floating roof which is intended to eliminate the vapor space above the surface of the stored liquid. To further remedy the problems related to evaporation, various forms of seals have been proposed for use with floating roofs. The seals are designed to close the vapor space between the perimeter of the floating roof and the tank shell.

While seals do remedy the evaporation loss problem, modern regulations are increasingly strict. Some of the requirements relating to evaporation loss are directed at the size of the gap which exists between the floating roof seal and the tank wall, and while these gap requirements have been relaxed from a strict "no-gap" requirement, they still remain stringent. Furthermore, it has been theorized that if gaps are present, wind effects can have a more significant influence on evaporation loss than if no gaps are present. Accordingly, improved seals for floating roofs are to be desired.

Among known seals are the metallic seals and the non-metallic sealing rings. However, with the stringent demands placed on the roof seal, these seals have been found lacking. The inventor is aware of several non-metallic seals. For example, U.S. Pat. No. 3,134,501, issued to R. W. Bodley, discloses a seal for a floating roof which includes a pneumatic tube surrounding the floating roof. The pneumatic tube is formed of a non-pliable material having a memory, that is, after deformation, the material having a memory resumes the pre-deformation shape, and therefore tends to resist deformation. The pneumatic tube disclosed by Bodley encircles the floating roof in a collar-like fashion. Such a seal suffers many drawbacks. For example, due to the natural resiliency of the pneumatic tube, and the material memory thereof, the seal cannot conform accurately to the tank wall shape, especially if that shape is not perfectly uniform, and gaps may exist between the seal and the wall thereby vitiating the effect of the seal. Even though the pneumatic seal of the Bodley Patent is more flexible than a metallic seal, the Bodley seal is not completely flexible, and accordingly, cannot effectively deform to fill gaps created by tank wall non-uniformities. Because the seal is supported in collar-like fashion, water from rain, snow, or the like, may collect on top of the seal, thereby creating problems.

There is yet another cause of difficulty in regard to the collar-like support of the Bodley seal. Mill scale, rust and the like from the tank shell and from the roof may fall and collect on top of the seal causing it to be loaded downwardly. In addition, in certain applications, the lower surface of the pneumatic seal will be immersed, and this immersed portion of the seal may change in dimension due to the chemical effect of the stored product on the seal. This chemical effect may cause, for example, a drastic shrinkage of the seal, thereby radically changing the geometry of the seal.

Furthermore, the seal in the Bodley Patent may allow loss from the tank due to permeation through the seal. Because the material of the Bodley seal has a memory and the seal therefore has some stiffness, the seal may ride up and lose contact with the stored fluid, thereby creating a vapor space with the attendant potential evaporation losses. Therefore, while the seal disclosed by Bodley does provide some advantages over other known seals, it still suffers many drawbacks.

Furthermore, in seals such as the Bodley seal, a longitudinal seam is required which must not be permeable, either by the gaseous fluid contained in the seal, or by the vapors from the stored product. Such longitudinal seams often leak and may vitiate the effectiveness of the seal.

It is also noted that, with reference to FIGS. 2 and 5 of the Bodley patent, the upper surface of the pneumatic tube runs essentially horizontally from the attachment point. The lower surface runs vertically downward toward the liquid surface from the attachment point. This means that the only mechanism available for holding the seal in the outward position is the bending stiffness of the fabric used in the seal, or whatever air pressure is present in the seal. While Bodley calls the seal a pneumatic seal, it is not disclosed that the seal is pressurized. Bodley does not disclose any kind of a pressurizing mechanism and there is no suggestion in the Bodley patent that the support of the seal is airtight. Therefore, any air inside the pneumatic tube is of no consequence in supporting that tube. Furthermore, from the Bodley disclosure, the bending stiffness of the material utilized in forming the tube appears to be small. Therefore the pneumatic tube disclosed by Bodley is limited in reach, that is, the dimension between the floating roof and the tank sidewall is limited to something on the order of 2 or 3 inches.

In FIG. 1 of the Bodley patent, the construction is disclosed for covered floating roof tanks. There is a fixed position external roof covering the internal roof to which the pneumatic tube is attached. This type of construction typically has a small seal and is quite limited.

The inventor is also aware of U.S. Pat. Nos. 2,297,985 and 3,255,914, issued to G. Rivers and J. W. Nelson, respectively, which disclose fluid filled seals. The first-mentioned patent discloses a seal comprising a canvas-like material which is attached to the deck of a floating roof. However, the seal is attached in a manner which defines a spillway through which the material used in the seal can flow. Fluid communication with the stored fluid is thereby established, producing several drawbacks.

With regard to the Rivers patent, it is noted that the liquid containing element disclosed by Rivers is attached to the roof at two elevationally spaced apart locations. As disclosed by Rivers, the upper end of the bag is open to the environment, and, as such, the sealing liquid is subject to evaporation with time and/or the collection of leaves, debris and other materials detrimental to the operation of the seal.

In addition, the scuffband material of the Rivers patent is not attached at its bottom end, but is merely draped across the seal. Friction between the scuffband and the tank wall is created by the loading of the scuffband by the liquid's pressure. The friction will tend to slide the scuffband from between the tube and the tank wall.

In addition, the Rivers scuffband does not hold the liquid containing member. The container walls are the structural elements holding the sealing fluid. Hence, the requirements of the seal construction must take into account this loading as well as the liquid containing ability, and therefore a fabric reinforced rubber, for example, is required.

The Nelson patent discloses a toroidal seal for a floating roof comprising a tube which is partially filled with fluid. The tube includes a pair of attaching tabs which are secured to roof mounted structure to attach the seal onto the roof. The Nelson seal includes a one-piece construction having a double wall on part of the circumference which forms a scuff surface. The attaching tabs are located at specific positions on the seal so the scuff surface will be properly oriented when the seal is attached to the roof. Special mountings are positioned on the roof to attach the seal to the roof.

While the seal disclosed by Nelson does overcome many of the drawbacks associated with metallic seals and some of the drawbacks mentioned with reference to the Bodley seal, the Nelson seal, along with all of the other seals known to the inventor, has several very serious drawbacks. These drawbacks are especially evident with the seal disclosed by Nelson, and will be discussed with reference to that patent, but it is to be understood that the drawbacks apply to the other above-discussed patents, as well as to the other seals known in the art prior to this disclosure.

In order to properly orient the Nelson seal on a floating roof, that seal must be moved across and about the roof prior to attachment. During movement of the seal during installation, especially the single ply portion thereof, the seal is very susceptible to being lacerated or otherwise punctured, thereby vitiating the integrity and sealing function of the seal. The seal must therefore be patched or otherwise mended prior to use. Such mending is tedious, difficult and often expensive. Some very large seals may have as many as one hundred punctures, thereby vitiating the integrity of the seal to a degree which may require replacement of the seal even before it is ever used. Because of the aforediscussed structure, tubular seals, such as the Nelson seal, often become twisted during installation, thereby creating additional points of wear, although the mounting of the Nelson seal may overcome any seal twisting problems. Such situations are clearly undesirable.

A further drawback to such tubular seals arises due to the difficulty in splicing such seals. By splicing, it is meant coupling two adjacent ends together. Such splicing occurs when two seals are coupled together, or when one seal is closed during the attachment thereof to a roof. Splicing is also required when a section of a seal is replaced.

Splicing of tubular seals is an extremely onorous procedure, often requiring several man hours to complete. With regard to mending such seals, it is noted that such seals are usually installed in the field by personnel involved in the erection of the tanks. Such personnel are usually not skilled in the art of working with elastomers, adhesives and the like. This fact makes any such mending expensive and questionable. All of the seals disclosed in the above-mentioned patents are subject to this difficulty due to the tubular nature thereof during installation, and due to the configurations thereof which require exact relative orientation of the two ends to be spliced. Any misorientation may result in puckering, wrinkling, or other seal integrity damaging condition. Precise alignment of two tube ends to be joined is especially difficult in the Nelson seal which has a double wall thickness on a portion thereof.

It is also noted that dimensioning of known seals on a tank has difficulties inherent in the design of such seals. Such difficulty is inherent because a length of flat material is being folded to surround a cylindrical tank. This difficulty is further exacerbated if the material is stiff or reinforced rubber, or the like. Such difficulties result in a seal which requires longer material length at the contact of the seal with the tank wall as compared to a length required at the mounting radius. These different circumferences must be accommodated by the pneumatic tube. The only way this accommodation can be effected is by stretching the tube material (restricted by fabric), or puckering, or other such distortion of the pneumatic tube. Such distortion results in gaps or other sealing difficulties. The geometry of the pneumatic seal further complicates this distortion.

Further, with regard to the Nelson patent, the tubular membrane is not only a liquid containing member, but also a load bearing member. Accordingly, in some instances, the weight of the liquid sealing member will be transferred to the mounting through the walls of the seal. The lower support means may not be able to support the weight of the tube and sealing liquid. The entire weight thereof is thus supported by an angle member and that weight is then transferred to that angle member via the seal tube walls. Such construction greatly limits the choice of materials, and virtually eliminates the use of a non-reinforced material.

Further, the double ply portion disclosed by Nelson is likely to require some adhesive bonding of two sheets of materials. If such bonding is used, the bonding adhesive is subject to chemical attack from the sealing fluid and for the stored product. Additionally, the interface between the two plys is subject to the formation of bubbles, blisters and the like.

Because of the structure of known seals, such seals have a limited volume available for containing the fluid. Thus, displacement of fluid is limited, thereby limiting the effectiveness of the seal in accommodating tank wall irregularities. Further, because of the limited volume, accommodation of thermal expansion and/or contraction of the liquid therein is limited, and venting structures are often required. Because of the requirement of longitudinal seams, seals such as those disclosed in the just-discussed patents are usually limited to small dimensions and are thus used only on internal floating covers or roofs. A non-pressurized pneumatic seal of this type simply cannot be made with large dimensions.

The inventor is also aware of the following U.S. Pat. Nos. 2,735,573, 3,135,415, 2,968,420, 3,154,213, 2,973,113, 3,228,551, 3,014,613, 3,228,702, 3,059,806, 4,014,454, 3,116,850.

Accordingly, there is need for a floating roof seal which is easily installed, spliced and which satisfies stringent gap requirements, even for tanks having some wall irregularities.

SUMMARY OF THE INVENTION

The seal embodying the teaching of the present invention is expeditiously installed on a storage tank floating roof, and is formed of pliable material so that the space between that floating roof and a storage tank wall remains substantially closed.

The seal comprises a single, unitary length of pliable material which is folded along the longitudinal axis thereof to superpose the side edges thereof. The end edges of the folded material are doubled and the superposed side edges and doubled end edges are closed to form a closed seal. The seal is attached to the floating roof to be positioned between the outer perimeter of that floating roof and the wall of a storage tank. Fluent material is placed in the closed seal through an entrance which is then closed.

As used herein, the term pliable refers to a material having little or no resistance to deformation in bending, elongation or contraction. It is noted that deformation is a function of two properties. The first property is the inherent stiffness of the material, usually quantified by some term such as modulus of elasticity. A very stiff material would thus have a high modulus of elasticity. Steel or glass is an example of a very stiff material. Rubbers have a very low modulus of elasticity and rubber-like materials are grouped under the heading elastomeric. The second property is related to the distribution of the substance or mass of material in the item being considered. If elongation or compression is considered, the property is area. A material with a large area is less pliable and more supple than another sample of the same material with different cross sectional area. If bending is considered, then the cross sectional moment of inertia is the important property. A material with a high moment of inertia is less supple and less pliable than one of the same physical material with a lesser moment of inertia.

As used in the present application, the term pliable refers to a material which has a relatively small resistance to deformation. Such materials include plastic films, certain fabrics and the like. The term non-pliable therefore refers to materials having a greater resistance to deformation. Such materials may, by their thickness or chemical composition, have a substantially greater resistance to deformation. Such materials as that disclosed in the Nelson patent is also a material which is non-pliable as the term is used herein.

This definition can be specifically related to the Nelson seal by considering a free body diagram of that seal. If the Nelson seal is considered when the roof is moving down, frictional forces which result from the contact from the seal against the tank wall act on the seal surface abutting the tank wall. Forces due to the weight of the material are also present and are substantially uniformly distributed over the geometry of the seal. There are also forces applied to the free body by the reaction. If a location on top of the seal or a location on the bottom of the seal are considered, the pneumatic seal resists the tendency for distortion caused by the frictional forces by means of the bending resistance of the seal at those locations. As such, the pneumatic seal is advisably made of a material with a relatively high bending resistance. The bending resistance has to be balanced against the need for compliance against the tank shell. In practice, foam rubber or sponge rubber sheet stock of thickness in the range of ¼ inch to ½ inch has been used as the material of which a seal of the pneumatic type has been made. The thickness of the sponge rubber provides the bending resistance necessary at the locations considered. The use of foam rubber provides the compliance with the tank shell.

In contrast to the Nelson seal, the seal embodying the teaching of the present invention is a liquid containing envelope which does not resist the weight of the sealing liquid. That weight is contained by the scuffband, the liquid containing envelope, even if initially loaded, will relax with time and transfer the load to the scuffband. Therefore, the envelope can be fabricated of a material which is thin (i.e., of a small cross sectional area and/or moment of inertia), and of low modulus of elasticity.

By being formed of a single, unitary length of pliable material, the envelope is easily formed by attaching one side edge to the floating roof, folding the material to position the other side edge on top of the first side edge, and closing the edges of the material to form the envelope.

A heavy, bulky seal need not be dragged about the roof to position the seal about a floating roof, and installation of the seal on the roof is very expeditious. As discussed above, known seals which are preformed into tubular shapes prior to connection thereof onto a floating roof are susceptible to being twisted or to being damaged while those seals are being positioned about the floating roof. The seal of the present invention can be shipped to the tank site as a roll of material, and then unrolled during installation. In fact, the unrolling can be accomplished as the material is being positioned to encircle the floating roof. The integrity of such a seal is therefore not endangered during a difficult positioning step.

Furthermore, by being formed of a single, unitary length of material, the envelope of the present invention is easily spliced, that is, adjacent ends of two lengths of material joined together. Thus, the ends of two lengths of flat material can be more easily and securely connected together than the ends of two lengths of tubular material because two pieces of flat material are easier to connect together in proper orientation and alignment than are two lengths of tubular material. The splicing can be done in the factory or in the field. As will occur to those skilled in the art, should an additional length of seal be required after installation, this additional length is easily inserted by closing the ends of the installed seal, and positioning the new seal adjacent those closed ends without need of connecting the ends of the insert to the ends of the in-place seal.

Still further, the unitary nature of the envelope material obviates the necessity of forming longitudinal seams in the envelope. Being free of longitudinal seams substantially reduces the likelihood of leaks and reduces the cost of the seal as the seaming operation is tedious and expensive. By not requiring a longitudinal seam, a wide choice of materials is permitted as compared to known seals which have longitudinal seams. In this manner, the seal embodying the present invention can be formed of material selected for the compatibility thereof with the product to be stored. As no seams are required, the envelope can be formed of Teflon, or like material, as opposed to the limited selection of materials for seals requiring a seam.

Still further, in the seal embodying the teachings of the present invention the upper ends of the bag are mounted to the floating roof in such a fashion that the sealing fluid is contained against contamination and evaporation loss. It is also noted that in the seal of the present invention the fabric can be unreinforced because it relaxes its load to the pontoon rim plate and/or to the scuffband material. Furthermore, the seal embodying the teachings of the present invention has both "sides" of a liquid filled envelope passing downwardly from the mounting only at an angle which is small when measured from the vertical. This means that the bending of the fabric is not of any consequence in holding the seal in position. Further, the envelope is enclosed in a scuffband which is attached at both the upper end of a pontoon as well as the lower portion of the pontoon below the liquid surface. This scuffband controls the position of the liquid filled envelope and the envelope then needs very little strength and is subjected to small load. In one form of the seal design, the fabric used for the liquid containing element is non-reinforced elastomeric material. As such, that fabric is subject to very large elongation under load and creep under load with time. This means that the container will "unload" itself and transfer the structural requirement of the design to the reinforced scuffband material. The envelope of the present invention therefore is an unloaded liquid containing or liquid controlling membrane.

As the envelope of the present invention is supported by a scuffband, an unreinforced elastomeric envelope material can be used, thereby producing advantages in cost of manufacture and ease of the repair. Also such designs increase the conformability of the seal. A greater quantity of fluent material can be accommodated in the seal of the present invention than can be accommodated in known seals, and accordingly, the present seal does not require refilling as often as do known seals.

The seal of the present invention has a substantial vertical length, and the sealing membrane is extended in the vertical direction thereby creating a large contact area of the seal against a tank well. This contact area is somewhat removed from the mounting loction. Also, in a liquid filled seal, the pressure which is exerted by the sealing liquid in the presently disclosed seal stretches the membrane materials and minimizes to some extent any difficulty related to surrounding a cylindrical tank with a length of material.

OBJECTS OF THE INVENTION

It is, therefore, a main object of the present invention to provide a liquid filled seal wherein the liquid containing envelope is as free as possible from the possibility of ruptures, tears, punctures and/or adhesive joint failure.

It is another object of the present invention to provide a seal for a floating roof of a floating roof storage tank which is expeditiously installed.

It is still another object of the present invention to provide a seal for a floating roof of a floating roof storage tank which can conform to irregularities in the annular space between the floating roof and the storage tank wall.

It is a further object of the present invention to provide a seal for a floating roof of a floating roof storage tank which is easily spliced and repaired.

It is yet another object of the present invention to provide a seal manufactured of materials not usable with standard seal design.

These together with other objects and advantages which will become subsequently apparent reside in the details of construction and operation as more fully hereinafter described and claimed, reference being had to the accompanying drawings forming part thereof, wherein like reference numerals refer to like parts throughout.

DETAILED DESCRIPTION OF THE INVENTION

Figure 1:
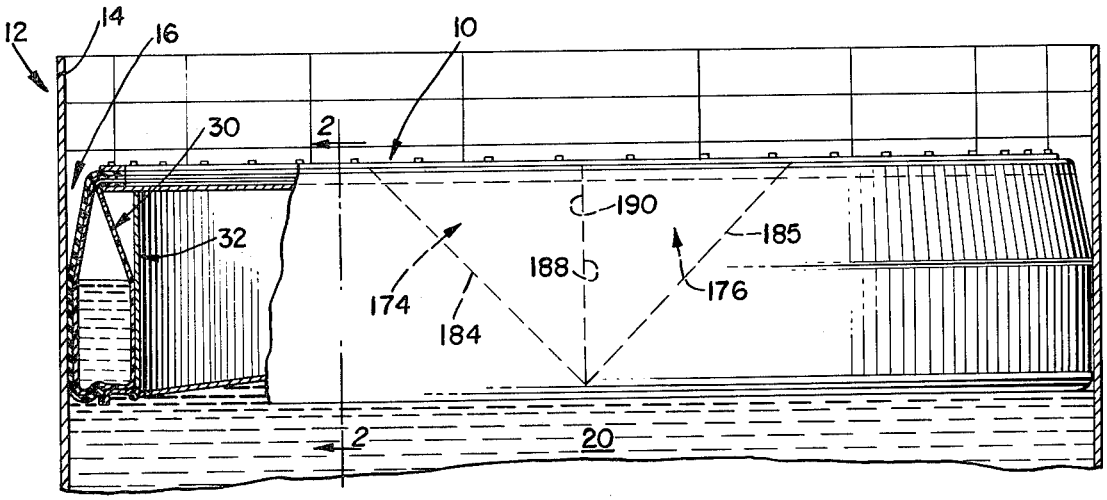
FIG. 1 is an elevation view partly in section of the top portion of a floating roof storage tank including the seal embodying the teachings of the present invention.

Shown in FIG. 1 is a generally circular floating roof 10 embodying the teachings of the present invention. The roof is located in a generally cylindrical tank 12 such as those used by the petroleum industry, and the outer perimeter thereof is spaced inwardly from tank wall 14 to define an annular space 16. The roof floats on the surface of product 20 in the usual manner, and as the level of product moves, the annular space 16 at any location varies. Thus, the space may be a maximum at one location and a minimum at a location on the roof diametrically opposite thereto. Furthermore, the tank wall 14 may be subject to non-uniformities and irregularities which cause the annular space to be non-uniform.

A liquid containing envelope 30 is attached to the floating roof to encircle the outer perimeter thereof and to close the annular space 16 between the roof wall 32 and the tank wall 14 to prevent, or at least inhibit, evaporation of product 20 via the annular space 16.

Figure 2:
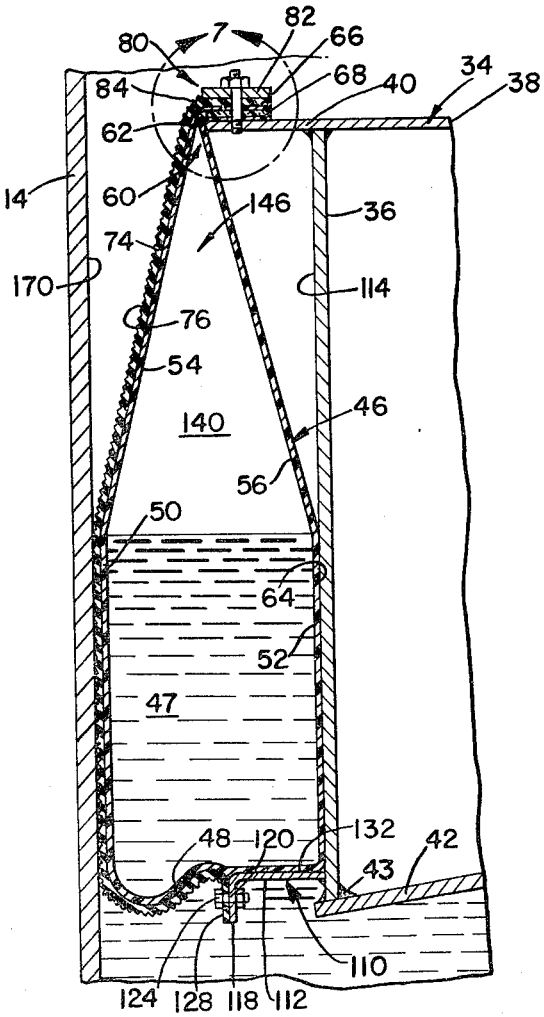
FIG. 2 is a view taken along line 2—2 of FIG. 1.

As shown in FIG. 2, the roof includes a hull 34 comprising a side wall 36 and a top 38. The top overhangs the side wall to define a mounting rim 40 to which the envelope 30 is attached, as will be later discussed. The roof also includes a liquid contacting deck 42 which is inclined upwardly from the wall and the side wall 36 rests on top of deck 42 and is connected thereto by a fillet weld 43.

The envelope 30 comprises a single, unitary section or length of pliable material 46 which is folded back onto itself to form the containment for the liquid. Therefore, when attached to the roof as shown in FIG. 2 with fluent material 47 therein, unitary material 46 is trapezoidally shaped in transverse cross-section and includes a base 48, a pair of parallel walls 50 and 52 and a pair of upwardly inclined converging walls 54 and 56 which form apex section 60 adjacent outer edge 62 of the top rim 40. The seal contacts the floating roof side wall 36 and outer surface 64 of wall 52, and the height of wall 52, as measured between base 48 and the juncture thereof to wall 56, is hereinafter referred to as the contact height of the envelope 30. It is noted that the contact height of the envelope can be adjusted by adjusting the level of the fluent material in the envelope. The pliable material is folded back over the rim 40 to form tails 66 and 68 which are extensions of walls 54 and 56, respectively. The tails are in spaced parallelism and can be coterminal, but can also be offset from each other without departing from the scope of the present invention.

A scuffband 74 supports most of the weight of the sealing liquid and covers that portion of the envelope 30 which is presented toward the tank wall 14. Such support is required as the envelope walls 54 and 56 are unloaded due to the elasticity thereof. The scuffband is comprised of a fabric reinforced rubber-like elastomer material, is relatively stiff as compared to the seal envelope material and has a serrated outer surface 76 and performs the function of protecting the envelope from abrasion and puncture during movements of the roof, and supporting the envelope in proper position and orientation as the roof moves. The scuffband 74 is formed of the flexible materials, such as a Buna-N coated nylon fabric. As used herein the term "seal" includes the entire structure located in the annular space 16. In other words, the "seal" includes the various mounting components, the scuffband, in contact with the tank wall, the sealing fluid and the liquid containing envelope.

Figure 7:
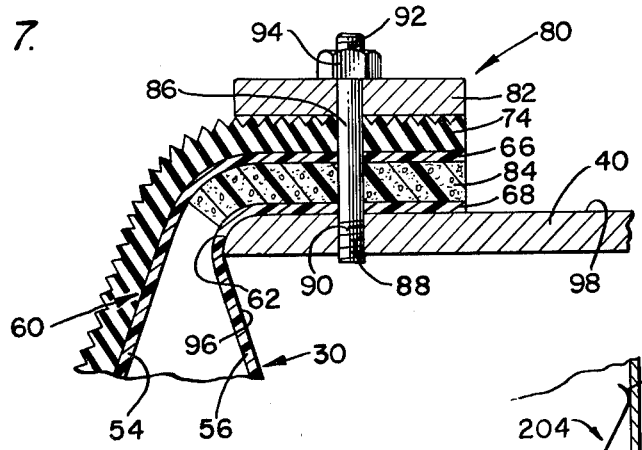
FIG. 7 is an elevation view of a clamp for attaching the seal embodying the teachings of the present invention to a floating roof.

As shown in FIG. 7, a clamp 80 attaches the seal to the rim 40. The clamp 80 includes a bolting bar 82, a bolster 84 and a welding stud 86. The studs are each "shot" onto the upper surface of the upper plate which eliminates the need for drilling and tapping any holes. Alternatively, bolts could be substituted for the welding studs if welding studs prove costly or a source of vapor leaks. The scuffband, the tails, and the bolster are all captured between the bolting bar and the top surface 98 of rim 40 in a layered manner. The scuffband and tails can have bolt receiving openings defined therein or can be punctured at installation, as suitable. As shown in FIG. 7, the bolster, scuffband and bolting bar are all coterminal with the tails 66 and 68 on one end, and have the other ends thereof staggered with respect to each other. However, the coterminal relationship can be departed from without departing from the scope of the present invention. Outer edge 62 of rim 40 is rounded so that the inner wall 96 of the seal will not be exposed to a sharp edge.

As shown in FIG. 7, one end of the bolster is curved to correspond to the curvature of rim outer edge 62. The bolting bar and bolster are annular to correspond to the circular shape of the roof, and can be formed of suitable materials. Thus, the bolting bar can comprise metal and the bolster can comprise a foam-like material.

As shown in FIG. 2, a bracket 110 is mounted on the roof wall 36 and includes a web 112 attached at one end thereof to outer surface 114 of the side wall 36, as by welding, and a flange 118 depending from the other end thereof. a plurality of bolt receiving openings 120 are defined in the flange 118, and bolts, such as bolt 124, are received therein. The scuffband 74 has a lower edge 128 which is attached to the flange 118 by bolts 124, and the envelope material rests on the top surface 132 of the web 112 to further support the envelope 30 in the sealihg position. Therefore, the envelope 30 is maintained in sealing position by the scuffband 74 and the bracket 110, with the scuffband being attached to the roof by the clamp 80 and the bracket 110.

The envelope 30 defines a volume 140 therein when the envelope is mounted on a roof, and the volume 140 is partially filled with fluent material 47 such as water, oil, kerosene, or other material suitable for use in such envelopes. A void volume 146 is defined in the envelope by the fluent material 47 and the envelope inner surface.

Figure 3:
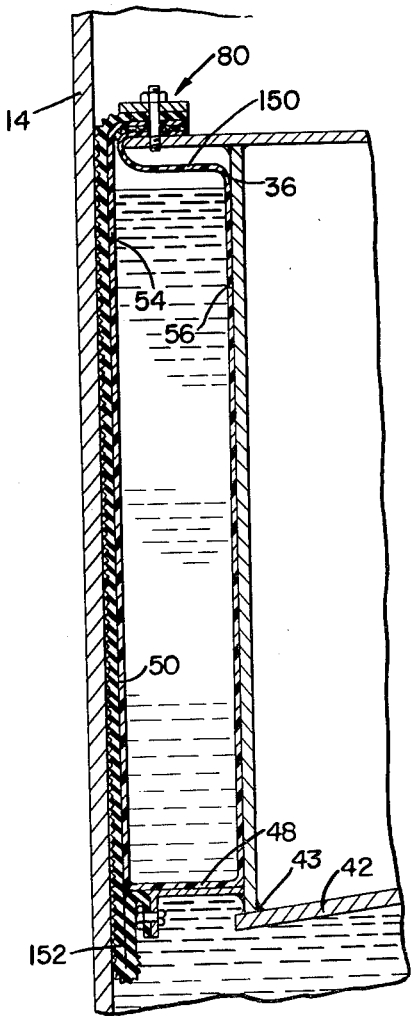
FIG. 3 is the FIG. 2 view after deformation of one form of the seal embodying the teachings of the present invention.

As shown in FIG. 3, for a segmented tube, upon shifting of the roof toward the tank wall 14, the annular space therebetween is reduced (due to the roof moving closer to the wall), thereby compressing the envelope. Upon compression of the envelope, the fluent material is displaced into the void volume 146, and the envelope is distorted from the FIG. 2 trapezoidal shape toward the FIG. 3 rectangular shape, wherein the converging walls 54 and 56 have become parallel, and wall 56 has folded over to form a top 150 for the rectangular envelope. The envelope contact height of the segmented envelope thus changes as the envelope shape shifts. This contact height shifting may be advantageous in the sense that different contact heights on opposite sides of the diameter will result in a net horizontal force pushing the roof away from the tight side and toward the open side to thus produce a self-centering effect for the roof. This self-centering feature is desirable in that it results in the best orientation for the roof as the roof floats on the liquid, that is, one side of the roof is not always tight and the other side of the roof is not always loose. Roofs can be pushed off-center, for example, by winds or turbulence in the product caused by product additions. As is also shown in FIG. 3, the scuffband is pinched into a fold 152 to permit the distortion of the envelope. Other configurations can, and probably will, be assumed by the envelope depending on the movement of the roof, the shape of the walls 14 and 36, and the like. The trapezoidal and rectangular shapes are shown for the sake of convenience, and are not intended to be limiting. It is noted that the volume 146 is selected so that at the minimum annular space size, there will be sufficient volume to accommodate the fluent material.

However, it is noted that the preferred embodiment of the present invention has nonsegmental sealing envelopes. Thus, in the preferred embodiment, as the annular space decreases on one side of the tank, that space automatically increases on an opposite side. The liquid is free to flow from the tight to the open portions of the annular space; therefore, there is a minimum change in height of sealing liquid in the sealing envelope. FIG. 3 is a modification of the invention, and could be used, for example, in situations requiring field repair with additional segments or portions of sealing envelope being intermittently placed in position.

Because the preferred form of the envelope 30 is formed of a single, unitary portion of pliable material, suitable material can be stored in long rolls and simply unrolled at the tank site. It is noted that even in the form of the invention comprising segmented tubes, each of the segments is unitary and integral in nature, that is, there are no discontinuities, lap seams or the like present in the tubes. Once a suitable length of material is removed, the material is cut and installed on a roof. The installation procedure includes the steps of attaching the material to the rim 40 by bolt 86 to form tail 68, walls 56 and 52, folding the material upwardly over itself to form walls 50 and 54, then folding the material again to form tails 56. The bolster is inserted between the tails, and the scuffband is attached to the bolt and to the bracket, and the clamp 80 is set.

Figure 6:
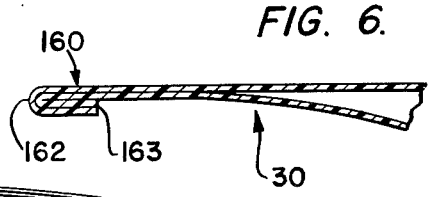
FIG. 6 is a plan view of a closed end edge of a seal embodying the teachings of the present invention.

The ends of the envelope can be closed for forming a double bond by folding the end edge back over itself as shown in FIG. 6 to form a hem 160 having an outer edge 162 and an inner edge 163. The hem is then sealed either adhesively, mechanically, or the like, to close the envelope. The ends shown in FIG. 5 are the preferred form, and are not double bonded as shown in FIG. 6, but merely sealed together in a suitable manner.

Figure 4:
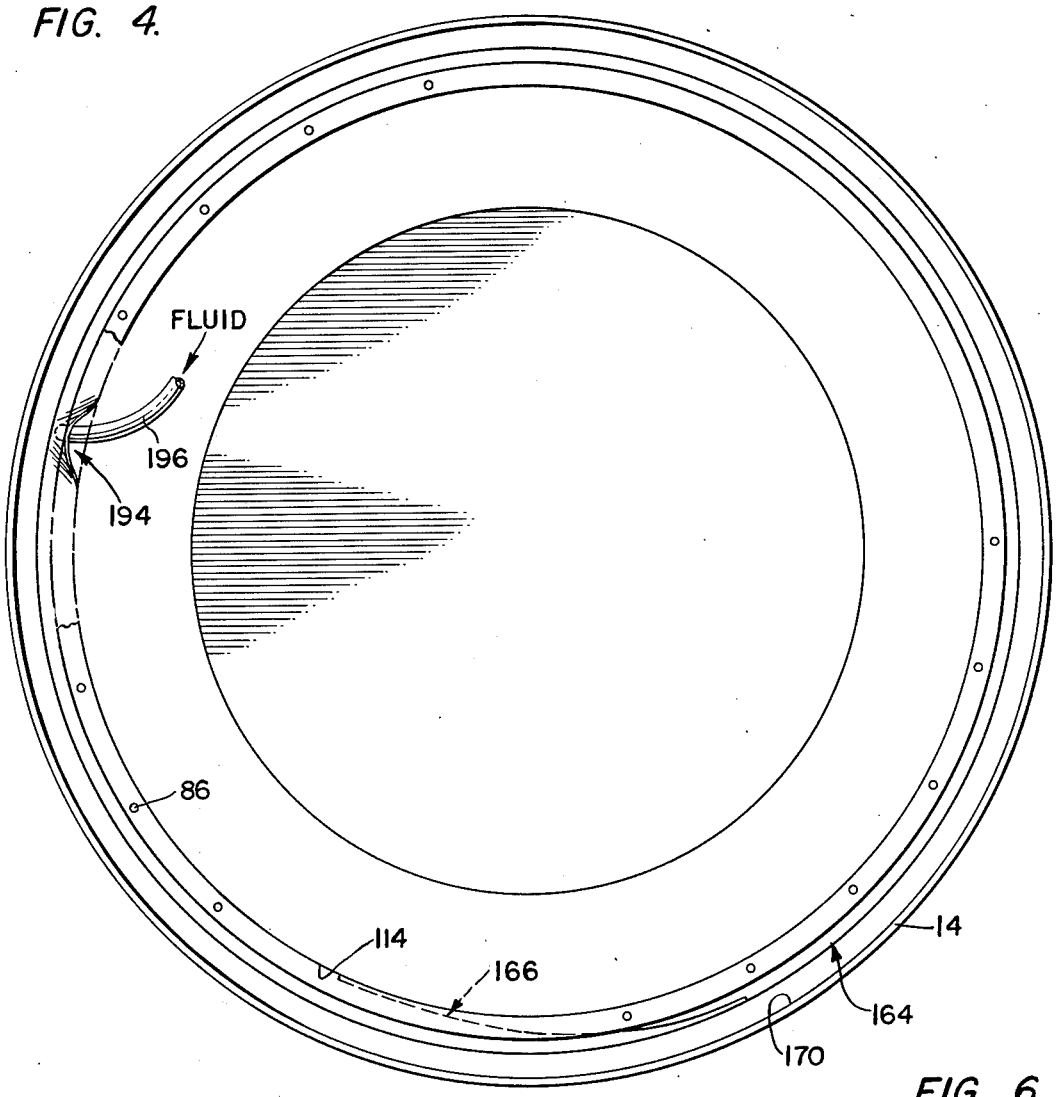
FIG. 4 is a plan view of a floating roof storage tank including the seal embodying the teachings of the present invention.

The two closed end edges of the envelope can be overlapped and attached together, as by adhesive or the like, to form an endless surface 164 as shown in FIG. 4 wherein the overlapping end portions are indicated by the reference numeral 166. As shown in FIG. 4, one end of the envelope is located between the other end of the envelope and the roof, thereby forming the overlap 166 which extends from outer surface 114 of roof wall 36 to near inner surface 170 of tank wall 14. The scuffband is interposed between the envelope and the inner surface 170, therefore, overlap 166 does not extend to the surface 170.

Figure 5:
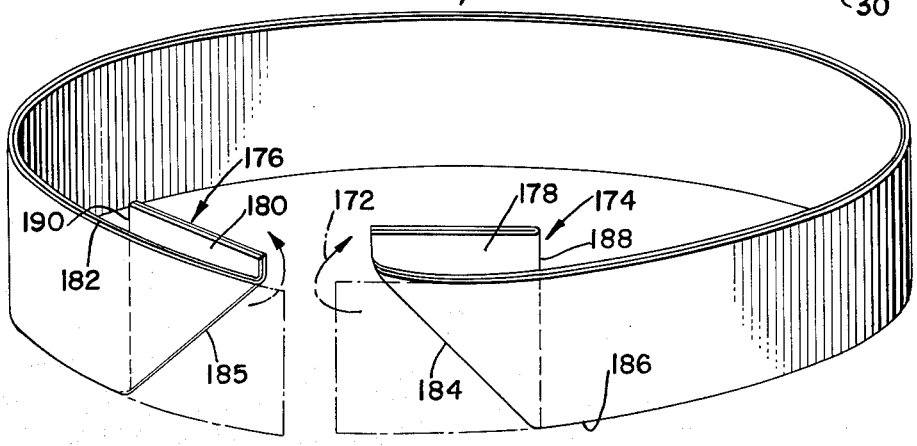
FIG. 5 is a perspective view of a seal embodying the teachings of the present invention.

Alternatively, the closed ends of the envelope can be folded upwardly as shown by arrow 172 in FIG. 5 to form ears 174 and 176 which are attached to the roof by clamp 80 at top flaps 178 and 180 thereof. The flaps are formed by that portion of the ears which extends beyond top edge 182 of the envelope. The folding of the ends forms a crease 184 on ear 174 and a crease 185 on ear 176. The creases are shown in FIG. 5 to be essentially at a 45° angle with respect to the envelope forming pliable side edge 182. However, other angles can be used without departing from the scope of the present invention. The lower side edge 186 of the envelope therefore forms edge 188 of ear 174 and edge 190 of ear 176, which are shown in FIG. 1 to be in abutting relationship, but can also be spaced apart.

It is, therefore, evident that a plurality of envelope sections can be used on a single roof simply by upfolding the ends of adjacent sections as shown in FIG. 5. A portion of the envelope can even be removed and replaced by simply removing the section, closing the ends of the remaining envelope, unfolding those ends, and forming a new, replacement section with the ends thereof closed and upfolding those ends as in FIG. 5, and attaching all of the upfolded ends to the roof by the clamp 80, with the replacement section located between the upfolded ends of the in-place section. The tube end design of the present invention is less susceptible to leaks than prior tube end designs requiring as many as three corner folds.

As shown in FIG. 4, inserting fluent material into the envelope can be accomplished with the envelope in situ. A segment of the clamping bar is freed from the rim 40 by loosening bolts 86, the envelope tails separated to form entrance 194, a fill tube 196 inserted through the entrance into the envelope volume 140, and fluent material 47 inducted into the envelope. The procedure can also be used to replenish material in the envelope. The entrance 194 can be located anywhere on the circumference of the envelope.

Figure 8:
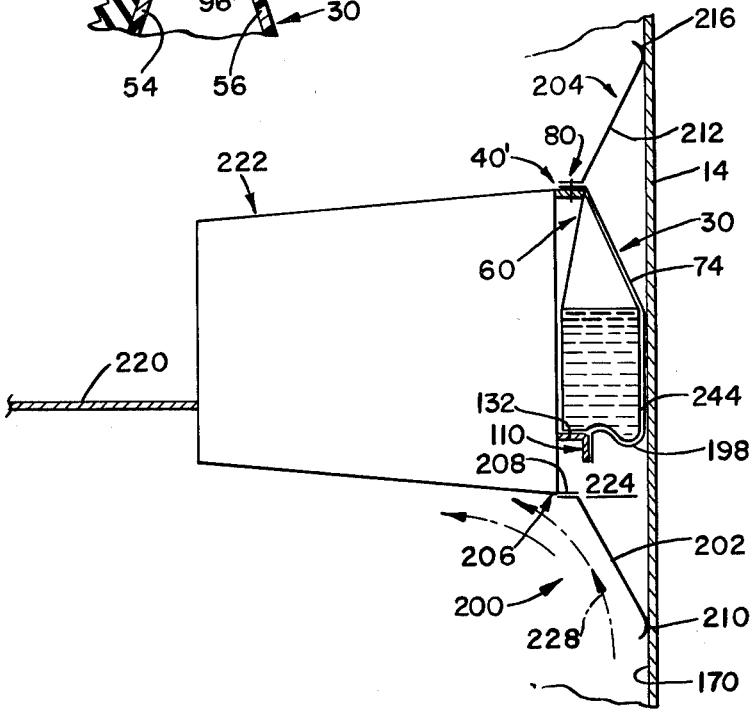
FIGS. 8 and 9 show floating roofs embodying alternative embodiments of the seal embodying the teachings of the present invention along with secondary seals.

An alternative embodiment of the seal embodying the teachings of the present invention is shown in FIG. 8 wherein the scuffband 74 is attached to the bracket 110, and the envelope shaped to define a bulge 198 at the end thereof which is remote from the apex section 60. A convection deflector 200 includes a plurality of overlapping skirt members, such as member 202. Each skirt member 202 is attached at one end thereof to lower edge 206 of the roof by a bracket 208, and which includes a runner 210 defined in the other end thereof. A weather shield 204 protects the primary seal from the elements and includes a plurality of overlapping top skirt members, such as member 212 which is attached at one end thereof to the roof top rim 40' by the clamp 80 and which has a runner 216 defined on the other end thereof. The weather shield keeps water and sunlight from entering the annular space where the product would be contaminated or the seal components degraded. The runners slidably engage the tank inner wall surface 170 as the roof moves in response to movements of the liquid stored in the tank. The floating roof is shown in FIG. 8 to include a deck 220 surrounded by pontoon section 222, but other forms of the roof can be used without departing from the scope of the present invention.

Convection deflectors are important in the control of evaporation losses from petroleum storage tanks. As sunlight impinges on the sidewall of the tank, there is a thin layer of liquid which is heated. The heating decreases the density of that liquid layer, thereby causing the fluid to rise upwardly in the vertical direction. Such a liquid would tend to be trapped in the space located below the primary seal as, for example, in the area adjacent flange 118 shown in FIG. 2. This convecting, relatively warm fluid is at a higher vapor pressure than the major body of the liquid and thereby large evaporation losses occur. The function of the convection deflector 200 is thus two-fold. First, the deflectors provide an isolated fluid space such as space 224 in FIG. 8, and force the convection currents rising along the vessel wall to circulate back under the roof as indicated by the arrows 228 in FIG. 8 to prevent, or at least inhibit, the tendency for the seal pocket to exist at a higher than average temperature causing increased evaporation loss. Secondly, a tendency is created for a volume of liquid to be trapped and isolated in space 224 in FIG. 8. This volume of trapped liquid will soon (through evaporation) lose its light ends and become weathered or "stale". Thereby the vapor pressure of that trapped liquid will be reduced and the lower vapor pressure will result in a smaller evaporation loss. The weather shield protects the seal from wind, and therefore further inhibits evaporation losses from the tank. Thus, it is noted that the weather shields on top of the roof are independent in purpose and operation from the convection deflectors located below the the roof. It is also noted that the weather shield might, if it were continuous, be called a secondary seal.

Figure 9:
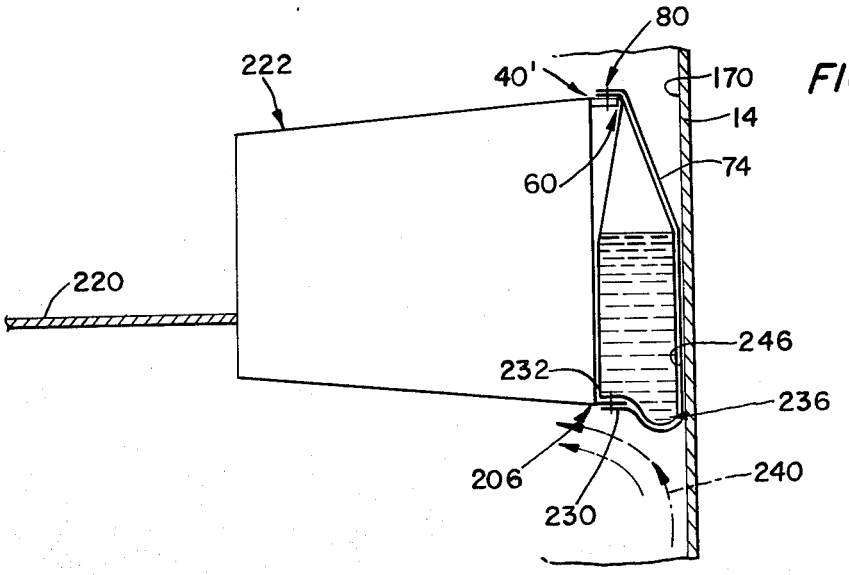

A further alternative of the seal embodying the teachings of the present invention is shown in FIG. 9, wherein the scuffband is attached to the roof lower edge 206 by a bracket 230 and the envelope rests upon upper surface 232 of the bracket. The scuffband and envelope are attached to rim 40' of the roof and bulge 236, similar to bulge 198, is defined on the portion of the envelope remote from the apex section 60. The bulge itself acts as the deflector for convection currents as indicated by arrow 240 in FIG. 9, and thus performs the function of the FIG. 8 convection deflector 200. The FIG. 9 embodiment is also shown in conjunction with a pontoon roof, but can be used on other forms of a floating roof as well without departing from the scope of the present invention.

As indicated by the arrows in FIGS. 8 and 9, convection currents caused by solar input are shunted back into the tank by the convection deflector rather than being trapped in a pocket located below the envelope 30. An isolated fluid pocket is formed by space 224, which, as the free liquid surface is at an elevation slightly higher than the deck 227 in FIG. 8, the space 224 is filled with liquid and is a dead product or dead liquid space, and the fluid therein become depleted in high vapor pressure components, thereby further reducing evaporation losses. In both the FIG. 8 and FIG. 9 embodiments, the lower portion of the envelope is immersed in stored product, so that the product has a top surface indicated by reference numberal 244 in FIG. 8 and 246 in FIG. 9.

As seen in FIGS. 2 and 3, the unitary material forming the envelope 30 is pliable, meaning that the material has no memory so tht a flexible seal which can easily be distorted by movement of the floating roof is formed. The completely flexible nature of the material permits the envelope to conform to the size and shape of the space defined between the tank and roof walls, even if one of those walls is slightly irregular to thereby form a non-irregular gap. The pliable nature of the envelope is seen in FIGS. 2 and 3, wherein the envelope changes shape to conform to whatever shape the gap 16 has assumed. Such a result enables the seal of the present invention to close the space to a degree not heretofore obtainable with prior seals.

The unitary nature of the material used to form envelope 30 permits easy installation and repair of the seal. A bulky tube need not be dragged about on the roof during installation, as has been heretofore required. As above-discussed, such movements of an envelope often puncture it, thereby requiring tedious and expensive repairs to a newly installed seal. Repair of envelope 30, as above-discussed, is also very expeditious as a flat piece of material is used as opposed to tubular materials.

In one embodiment of the seal embodying the teachings of the present invention, the length of walls 50 and 52 from base 48 to lower edges of walls 54 and 56 is 10½ inches, and the height of the triangular section formed by inclined walls 54 and 56 as measured from the lower edges thereof to the apex section 60 is 9½ inches. In such an embodiment, the gap 16 varies from a 9 inch maximum to a 3 inch minimum and is nominally 6 inches wide as measured from the outer surface 76 of the scuff-band to the inner wall surface 170. The bolting bar preferably has dimensions of 1½ inches in width and ¼ inch in thickness, and the bolster is preferably a PVC foam seal having a width of 1¼ inches and thickness of ¼ inch, and the hem 160 has a width of about 2 inches as measured from edge 162 to edge 163.

In the FIG. 8 embodiment, the bulge prefeably extends approximately 1 to 2 inches beneath the top surface 132 of flange 110, and in the FIG. 9 embodiment, the bulge preferably extends approximately 1 to 2 inches beneath the lower surface of the roof, and the roof has a thickness of between 23½ inches and 31 inches. In the FIG. 8 embodiment, the flange top surface 132 is approximately 4 inches above the flange 208, and the connection of the seals to the flanges utilizes welded studs. The skirts can be manufactured of standard materials.

It is noted that two envelopes can be attached to the rim to overlap and thus form a double seal. Furthermore, envelopes can be attached to the roof in end adjacent manner to produce longer reaches. A single envelope can have a longitudinal extent slightly greater than the circumference of the roof and the ends overlapped if desired.

It is further noted that envelope filling material can include a closed cell foam material located within fluent material 47 and apex section 60 in volume 146 to expand the reach of the envelope, or to prevent total collapse in the event of an envelope rupture.

Segmented envelopes can also be used with a liquid fill, and can be used with or without small vents or other means for adjusting the ratio of vapor to liquids inside the envelope.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. In a floating roof storage tank, a seal on the floating roof for closing a space defined between the floating roof and a tank wall comprising:

a single thickness, unitary length of pliable material, said length of material having on opposite ends of said length of material end edges, and side edges on opposite sides of said length of material, and a longitudinal centerline, said length of pliable material being folded back on itself near said longitudinal centerline, said opposite side edges being superposed with each other;

closing means closing said end edges;

first attaching means attaching said superposed pliable material side edges to a storage tank floating roof so that said folded length of material is capable of containing a fluent material therein, said pliable material being attached to a storage tank only by said first attaching means;

a fluent material contained in said folded length of material; and a scuff band positioned on said seal to be interposed between said pliable material and a storage tank side wall, said scuff band having a pair of opposite side edges and being separate from said length of pliable material and being attached to the floating roof at one side edge thereof by said first attaching means and at the other side edge thereof by a second attaching means, said scuff band supporting said length of pliable material and said fluent material contained therein, said pliable material being continuous and unattached to the floating roof adjacent said second attaching means.

2. The seal defined in claim 1 further including clamping means attaching said scuff band and said superposed seal edges to a storage tank floating roof.

3. The seal defined in claim 2 wherein said clamping means includes a bolting bar, a bolster and a bolt connecting said clamping means to a storage tank floating roof.

4. The seal defined in claim 1 further including a secondary seal mounted on such storage tank floating roof.

5. The seal defined in claim 4 wherein said secondary seal includes a first skirt member attached at one end to such storage tank floating roof and having a runner at the other end thereof for slidably contacting a wall of a storage tank.

6. The seal defined in claim 5 wherein said first skirt member is connected to such floating roof adjacent the top of such floating roof.

7. The seal defined in claim 6 further including a second skirt member attached at one end to such storage tank floating roof and having a runner at the other end thereof for slidably contacting a wall of a storage tank.

8. The seal defined in claim 7 wherein said second skirt member is connected to such floating roof adjacent the bottom of such floating roof.

9. The seal defined in claim 1 further including a bulge defined in said pliable material at a location remote from said superposed side edges.

10. A method of forming a seal for use on a floating roof of a floating roof storage tank to close a space defined between such floating roof and a tank wall, comprising:

providing a single ply unitary length of pliable material, said pliable material having end edges on opposite ends of the material, side edges on opposite sides of the material and a longitudinal centerline;

folding said pliable material back on itself near the longitudinal centerline;

superposing the pliable material side edges;

closing the pliable material end edges;

attaching only the superposed end edges to a storage tank floating roof to form a closed seal to render the folded material capable of containing a liquid;

placing fluent material in said closed seal;

potitioning a separate scuff band to be interposed between the folded pliable material and a storage tank side wall, said scuff band having top and bottom side edges;

attaching both of said scuff band side edges to a floating roof;

supporting the fluent filled pliable material by the scuff band; and maintaining said pliable material unattached to a storage tank side wall adjacent said scuff band bottom edge.

11. The method defined in claim 10 further including a step of defining a secondary seal adjacent the closed seal.

12. The method defined in claim 11 wherein the folding step includes defining a bulge in the pliable material at a location remote from the superposed side edges.

13. The method defined in claim 10 wherein the step of attaching said pliable material closed ends to such storage tank floating roof includes a step of folding one of said closed ends at an angle so that said closed end is oriented in a direction substantially the same as said pliable material side edges.

14. The method defined in claim 10 further including a step of storing said pliable material in a rolled up condition.

15. The method defined in claim 14 further including a step of orienting said pliable material to surround such floating roof as said pliable material is unrolled.

16. The seal defined in claim 1 wherein said pliable material closed ends are folded to extend in a direction substantially the same as said pliable material side edges.

17. The seal defined in claim 16 further including means for attaching said pliable material closed ends to such storage tank floating roof.

18. A seal for use between a floating roof and the wall of a storage tank used for storing fluid, the seal comprising:

a single thickness flat substantially rectangular sheet of elastomeric material bent back on itself about a line parallel with the long side edges of said rectangular sheet so that such long sides are in superpositioned relationship to form a fluid containing pocket, such superpositioned long sides being attached to a storage tank near the top outside perimeter of such storage tank;

first attaching means attaching said elastomeric material to a storage tank floating roof, said elastomeric material being attached to such storage tank only by said first attaching means;

a fluid located within said fluid containing pocket; and a scuffband attached to a floating roof, said scuffband being separate from said pliable material and including a substantially rectangular sheet of elastomeric material with upper and lower edges, said scuffband upper edge being attached to a storage tank by said first attaching means, said scuffband lower edge being attached to such floating roof by a second attaching means with said upper edge being attached near the top outside perimeter of such floating roof and said lower edge being attached near a surface of said fluid, said scuffband being positioned between said fluid containing pocket and a tank wall and supporting said fluid containing elastomeric material, said pliable material being unattached to such floating roof adjacent said scuffband lower side edge.

19. A seal for use with floating roofs in storage tanks used for storing fluids, the seal comprising:

a scuffband attached to a floating roof and including at least one elongate sheet of elastomeric coated fabric, said sheet being positioned to form an annular ring about such floating roof, said scuffband including upper and lower side edges with said upper and lower edges each being attached to such floating roof by first and second attaching means, respectively, said lower side edge being located near the level of fluid stored in a storage tank and said upper side edge being located near the top outside perimeter of such floating roof;

a separate fluid containing element including at least one elongate sheet of pliable elastomeric material, said sheet of pliable elastomeric material being positioned to form an annular ring and including side edges and end edges, said sheet of pliable elastomeric material being folded back on itself such that said side edges are superposed and attached to such floating roof near the top perimeter of such floating roof, said fluid containing element being attached to such floating roof only by said first attaching means and being unattached to such floating roof adjacent said scuffband lower side edge, said fluid containing element being located between such floating roof and said scuffband, said scuffband supporting said fluid containing element; and a fluid located within said fluid containing element.

20. The seal of claim 19 further including a plurality of sheets of elastomeric coated fabric, each sheet of elastomeric coated fabric being located adjacent a neighboring sheet of elastomeric coated fabric, and a plurality of sheets of pliable elastomeric material, each sheet of pliable elastomeric material being located adjacent a neighboring sheet of pliable elastomeric material.

* * * * *